US006072403A

United States Patent [19]

Iwasaki et al.

[11] Patent Number: 6,072,403

[45] Date of Patent: Jun. 6, 2000

[54] DOOR UNLOCKING DEVICE FOR VEHICLE

[75] Inventors: Yukio Iwasaki; Toru Maeda; Yoshio Nakano; Hiromitsu Mizuno; Hirofumi Okada, all of Aichi, Japan

[73] Assignee: Kabushiki Kaisha Tokai Rika Denki Seisakusho, Aichi, Japan

[21] Appl. No.: 08/986,189

[22] Filed: Dec. 5, 1997

[51] Int. Cl.[7] ..... G08C 19/00

[52] U.S. Cl. ..... 340/825.31; 340/829.34; 307/10.2; 180/287

[58] Field of Search ..... 340/825.31, 825.34, 340/825.32, 825.69, 825.72; 307/10.2, 10.1; 180/287

[56] References Cited

U.S. PATENT DOCUMENTS

| | | | |
|---|---|---|---|
| 5,252,965 | 10/1993 | Gidwani et al. | 340/825.56 |
| 5,723,911 | 3/1998 | Glehr | 307/10.2 |
| 6,002,341 | 12/1999 | Ohta et al. | 340/825.31 |

FOREIGN PATENT DOCUMENTS

| | | |
|---|---|---|
| 589158A1 | 3/1994 | European Pat. Off. . |
| 44 35 894 A1 | 4/1996 | Germany . |
| 195 16 316 A1 | 11/1996 | Germany . |
| 196 17 038 A1 | 11/1997 | Germany . |
| 9-250265 | 9/1997 | Japan . |
| 410159419 | 6/1998 | Japan . |

*Primary Examiner*—Melvin Marcelo
*Attorney, Agent, or Firm*—Morgan, Lewis & Bockius LLP

[57] ABSTRACT

A door unlocking device for a vehicle includes transmit/receive device activated to send an operation signal to a portable transceiver and receives an identification code from the transceiver, the transmit/receive device unlocking a door locking mechanism when the identification code matches a preset registration code, a starter switch activating the transmit/receive device when a door knob of an exterior door handle is pressed toward a vehicle body through first door handle actuation, and the door knob actuated to a first operation position and unlock unit unlocking the door locking mechanism when the door knob of the exterior door handle is actuated to a second operation position as a result of second door handle actuation subsequent to the first door handle actuation in the direction opposite to the direction of the first door handle actuation.

5 Claims, 12 Drawing Sheets

DOOR UNLOCKING DEVICE FOR VEHICLE

BACKGROUND OF THE INVENTION

1. Field of the Invention

The present invention relates to a door unlocking device for a vehicle which unlocks a door locking system when an identification code received from a portable transceiver matches a preset registration code.

2. Related Art

An existing door unlocking device for a vehicle unlocks a door locking mechanism when an identification code received from a portable transceiver matches a present registration code. Such a door unlocking device has the following structure. In short, when the portable transceiver approaches a transmit/receive apparatus mounted on a vehicle, a power signal is transmitted to the portable transceiver from the transmit/receive apparatus. In response to the power signal, the transceiver sends an identification code to the transmit/receive apparatus. When the identification code matches the registration code, the door locking mechanism is unlocked. In this case, the transmit/receive apparatus is designed so as to intermittently send the power signal in order to prevent consumption of a battery, thereby reducing power consumption.

A starter switch for detecting the pulling of the door handle is disposed on the reverse side of an exterior door handle in the vicinity of a driver's seat. When the door handle is pulled to a given position, the starter switch is turned on, so that the transmit/receive apparatus sends the power signal to the transceiver. In response to the power signal, the transceiver returns an identification code to the transmit/receive apparatus.

However, the foregoing door unlocking system suffers from the following problems. More specifically, in the case of the door unlocking system in which the power signal is intermittently sent to the transceiver from the transmit/receive apparatus, the transceiver suspends transmission of the identification code when the power signal is not transmitted; i.e., when the transmit/receive apparatus is in a standby condition. The door cannot be opened at this time, thereby inconveniencing the driver.

In a door unlocking device having a starter switch positioned on the reverse side of the exterior door handle, the starter switch is turned on when a door knob is pulled to a given position, so that an identification code is transmitted. However, it takes a certain amount of time to decode the identification code. If the door knob is pulled up to a position where the door locking mechanism is to be unlocked before the door locking mechanism is released from a locked state, it becomes impossible to open the door and the door becomes disabled, thereby inconveniencing the driver.

More specifically, an existing door unlocking device for a vehicle unlocks a door locking mechanism when an identification code transmitted to a transmit/receive apparatus from a portable transceiver matches a preset registration code. Such a door unlocking device comprises a starter switch positioned on the reverse side of an exterior door handle in the vicinity of the driver's seat.

In such a door unlocking device, when the door knob is actuated to a switching position along the way to a predetermined pivotal location, the starter switch is turned on. A start signal is output to the transmit/receive apparatus from the starter switch to thereby activate the same. The transmit/receive apparatus then transmits a power signal to the transceiver. In response to the power signal, the transceiver sends an identification code to the transmit/receive apparatus. When the identification code matches the registration code, the door locking mechanism is released from a locked state. When the door knob is actuated to a predetermined pivotal position after the door locking mechanism has been released from a locked state, the door locking system is unlocked on condition that the door locking system has already been released from a locked state, thereby allowing the opening of a door.

However, in the case of the door unlocking system having the foregoing configuration, it takes a certain amount of time from after the starter switch has been turned on as a result of actuation of the door knob to the switching position until the identification code is decoded. If the door knob is actuated up to a position where the door locking mechanism is to be unlocked before the door locking mechanism is released from a locked state, it becomes impossible to open the door, thereby inconveniencing the driver.

SUMMARY OF THE INVENTION

The present invention has been contrived in view of the foregoing drawbacks in the prior art, and the object of the present invention is to provide a door unlocking device for a vehicle which unlocks a door locking system when an identification code received from a portable transceiver matches a preset registration code and enables an improvement in the ease of use of the door unlocking system.

Another object of the present invention is to provide a door unlocking device for a vehicle which releases a door locking system from a locked state when an identification code received from a portable transceiver matches a preset registration code and enables an improvement in the ease of use of the door unlocking system.

The present invention provides a door unlocking device for a vehicle including a transmit/receive device which is activated to send an operation signal to a portable transceiver and receives an identification code from the transceiver; the transmit/receive device unlocking a door locking mechanism when the identification code matches a preset registration code, the door unlocking device comprising:

a starter switch which activates the transmit/receive device when a door knob of an exterior door handle is pressed toward a vehicle body through first door handle actuation, and the door knob is actuated to a first operation position; and unlock device which unlocks the door locking mechanism when the door knob of the exterior door handle is actuated to a second operation position as a result of second door handle actuation subsequent to the first door handle actuation in the direction opposite to the direction of the first door handle actuation.

In the foregoing door unlocking device for a vehicle, when the door knob is actuated to the first operation position through the first door handle actuation, the starter switch activates the transmit/receive device. The transmit/receive device sends the operation signal to the transceiver and receives the identification code from the transceiver. If the identification code matches the preset registration code, the door locking mechanism is unlocked. When the door knob is actuated to the second operation position as a result of second door handle actuation performed after the first door handle actuation, the door locking mechanism is unlocked by means of the unlock device.

In this case, the first door handle actuation is intended to press the door knob of the exterior door handle toward the vehicle body, and the second door handle actuation is intended to actuate the door knob in the direction opposite to the direction of the first door handle actuation. As a result, it takes a certain amount of time for the door knob to be actuated to the second operation position from the first operation position. Namely, it becomes possible to gain time to decode the identification code. Consequently, the door locking mechanism can be properly released from a locked state, as well as can be unlocked, thereby resulting in an improvement in the ease of use of the door unlocking device.

Further, the door unlocking device may be configured so as to comprise a tactile feedback device which imparts tactile feedback to the door knob when the door knob is actuated to the first operation position. By virtue of the tactile feedback device, resistance is imparted to the actuation of the door knob from the tactile feedback device. Accordingly, the driver can become aware of the time at which the door locking mechanism is unlocked. Furthermore, the door knob can be actuated to the first operation position without failing, thereby preventing the pressing of the door knob which is greater than required.

The present invention provides a door unlocking device for a vehicle comprising:

transmit/receive device which is activated to send an operation signal to a portable transceiver and receives an identification code from the transceiver;

a starter switch which is usually positioned in such a way that an operation section is pressed by a door knob of an exterior door handle, which activates the transmit/receive device when detecting the initiation of actuation of the door knob by release of the operation section;

release device which release a door locking mechanism from a locked state when the identification code matches a preset registration code; and unlock device which unlocks the door locking mechanism when the door knob of the exterior door handle is actuated to a predetermined position.

In the foregoing door unlocking device for a vehicle, when the door knob of the exterior door handle is actuated to thereby release the operation section of the starter switch from a pressed state, the starter switch detects the initiation of operation of the door knob. As a result, the transmit/receive device is activated to thereby send an operation signal to the transceiver, and receives the identification code from the transceiver. If the identification code matches the registration code, the release device releases the door locking mechanism from a locked state. Furthermore, when the door knob is actuated to a predetermined pivotal position, the unlock device unlocks the door locking mechanism.

As a result, when the door knob is actuated, the transmit/receive device is immediately activated and transmits the operation signal. Accordingly, it takes a much longer time to decode the identification code when compared with the time required by the existing door unlocking device. Consequently, the door locking mechanism can be properly released from a locked state, as well as can be unlocked, thereby resulting in an improvement in the ease of use of the door unlocking device.

Furthermore, in the door unlocking device having the foregoing configuration, the starter switch may be arranged so as to comprise a pressure sensor positioned on a handle bracket of the exterior door handle. By virtue of the pressure sensor, the pressure sensor operates in association with the actuation of the door knob, which in turn allows faster activation of the transmit/receive device.

Furthermore, in the door unlocking device having foregoing configuration, the pressure sensor may be configured so as to have the capability of absorbing physical shock arising between the door knob and the handle bracket. By virtue of the buffering capability, the pressure sensor can absorb physical shock arising between the door knob and the handle bracket when the door knob is returned to its original position.

BRIEF DESCRIPTION OF THE DRWINGS

DETAILED DESCRIPTION OF THE PREFERRED EMBODIMENTS

First Embodiment

Figure 1:
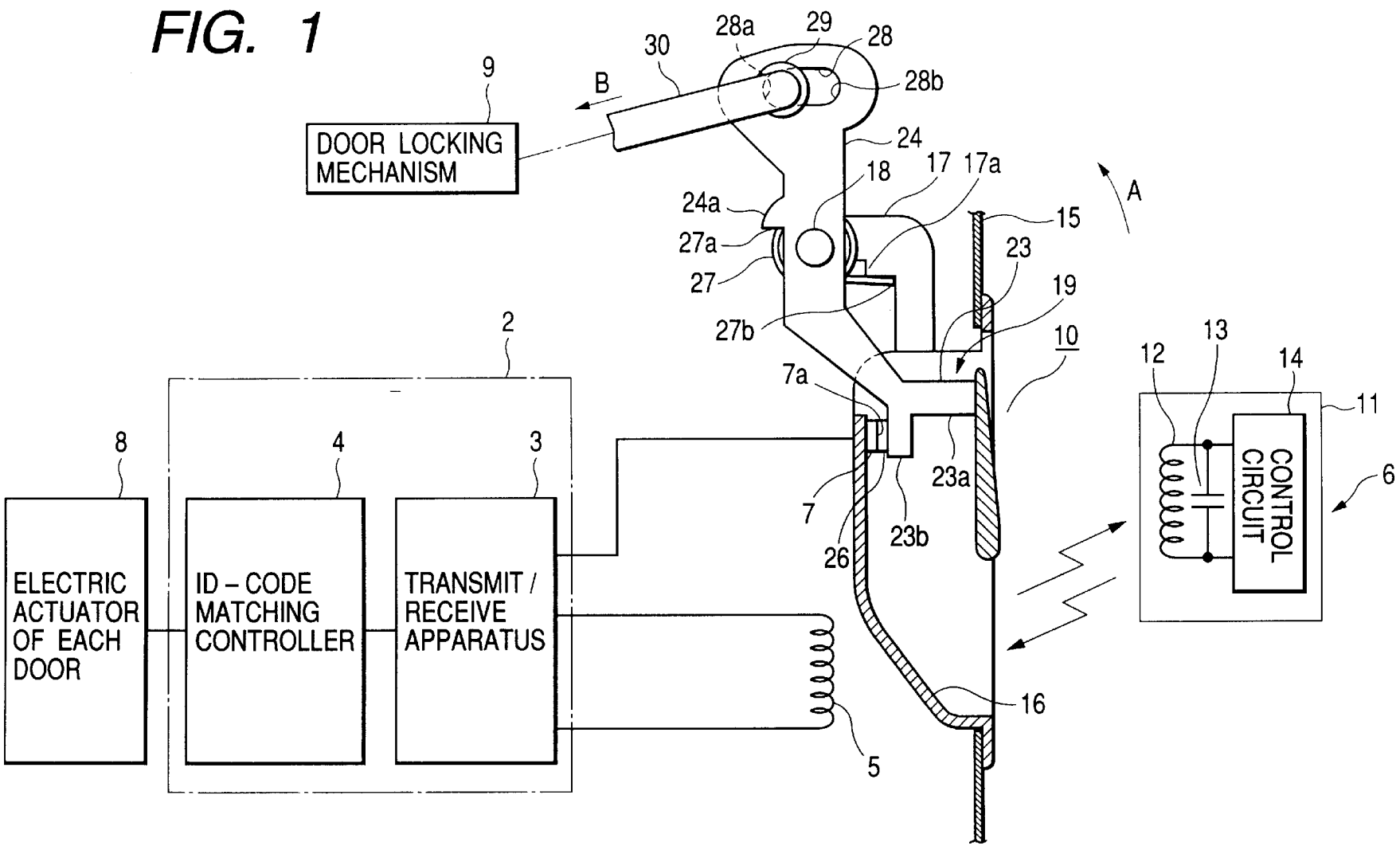
FIG. 1 is a partially-broken general view of a door unlocking device in accordance with one embodiment of the present invention.

By reference to the accompanying drawings, a first embodiment of the present invention will be described hereinbelow. First, an electrical configuration of the door unlocking device for a vehicle will be described by reference to FIG. 2.

A controller 2 disposed on a vehicle body 1 has a transmit/receive apparatus 3; and which serves as transmit/receive device, and an ID code matching controller 4. The transmit/receive apparatus 3 has the function of sending as a request signal (corresponding to an operation signal according to the present invention) a magnetic signal (i.e., a power signal) used for activating a transceiver 6 to be described later from an antenna 5, as well as the function of receiving as a response signal a magnetic signal including an identification code from the transceiver 6.

The ID code matching controller 4 decodes the identification code received by the transmit/receive apparatus 3 and determines whether or not the identification code matches a preset registration code. If there is a match between the codes, a door lock release instruction signal is output to an electric actuator 8 for each door. Upon receipt of the door unlock instruction signal, the electric actuator 8 applies electric power to an unillustrated electromagnet for unlocking purposes, thereby releasing a door locking mechanism 9 (see FIG. 1) to be described later from a locked state.

By reference to FIGS. 1 through 3, a more specific configuration of an exterior door handle 10 of the vehicle body 1 and the transceiver 6 will be described.

The foregoing transceiver 6 comprises an IC card 11. The IC card 11 comprises an antenna 12 including a coil, a capacitor 13 connected across the antenna 12, and a control circuit 14 which includes an IC connected across the capacitor 13.

When the IC card 11 receives the request signal from the antenna 12, the thus received request signal is delivered to the control circuit 14. The control circuit 14 is activated by the request signal, and a drive signal is sent to the parallel circuit consisting of the antenna 12 and the capacitor 13. The antenna 12 is activated by the drive signal and sends a magnetic signal including an identification code as a response signal to the antenna 5 of the vehicle body 1.

The exterior door handle 10 comprises a handle bracket 16 mounted on a door 15; and a door knob 19 supported by an L-shaped support piece 17 via a shaft 18 so as to pivot in a direction designated arrow A (hereinafter referred to as direction A) shown in FIG. 1. The L-shaped support piece 17 protrudes from an upper portion of the handle bracket 16.

Figure 2:
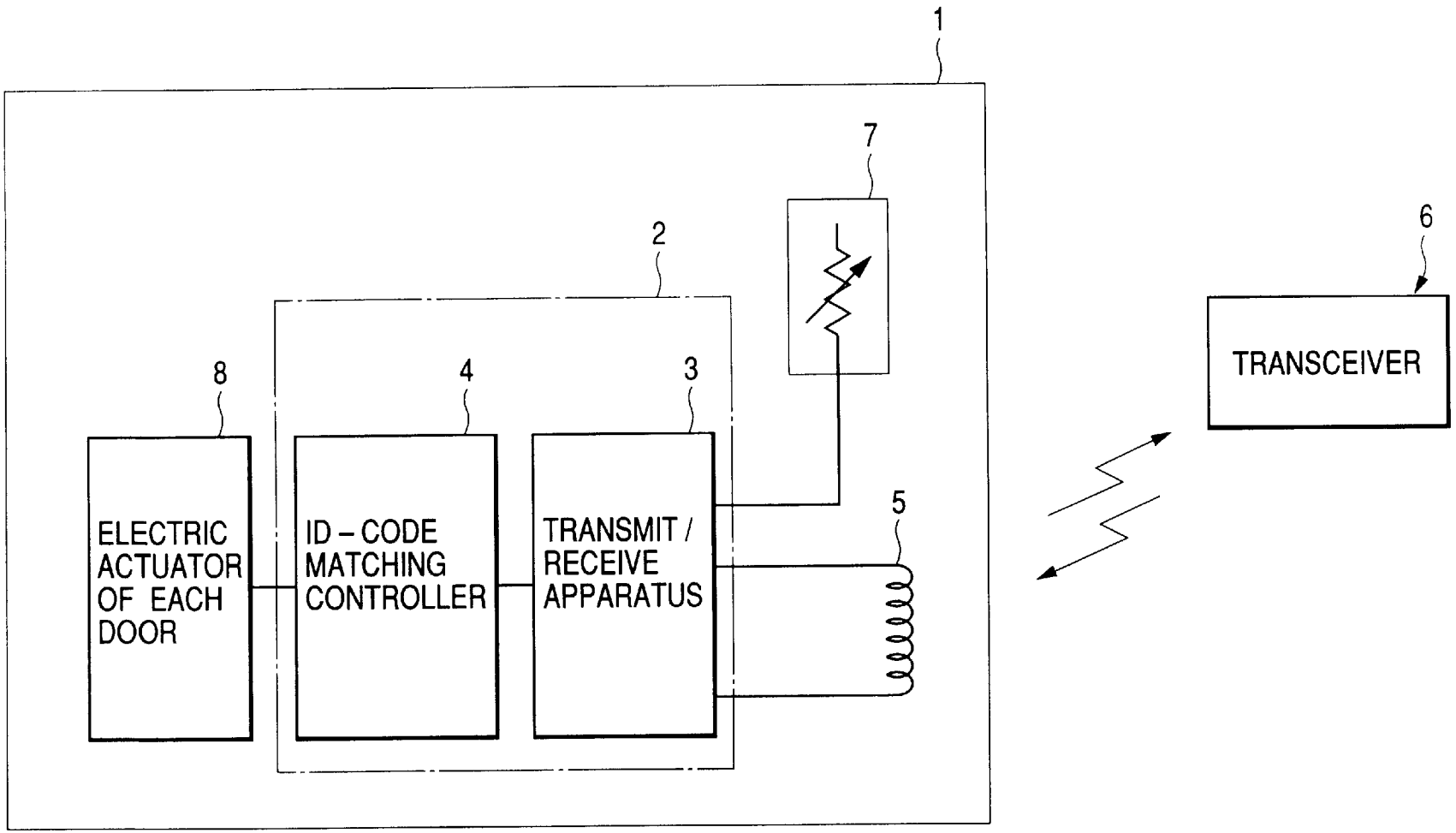
FIG. 2 is a block diagram showing an electrical configuration of the door unlocking device.
Figure 3:
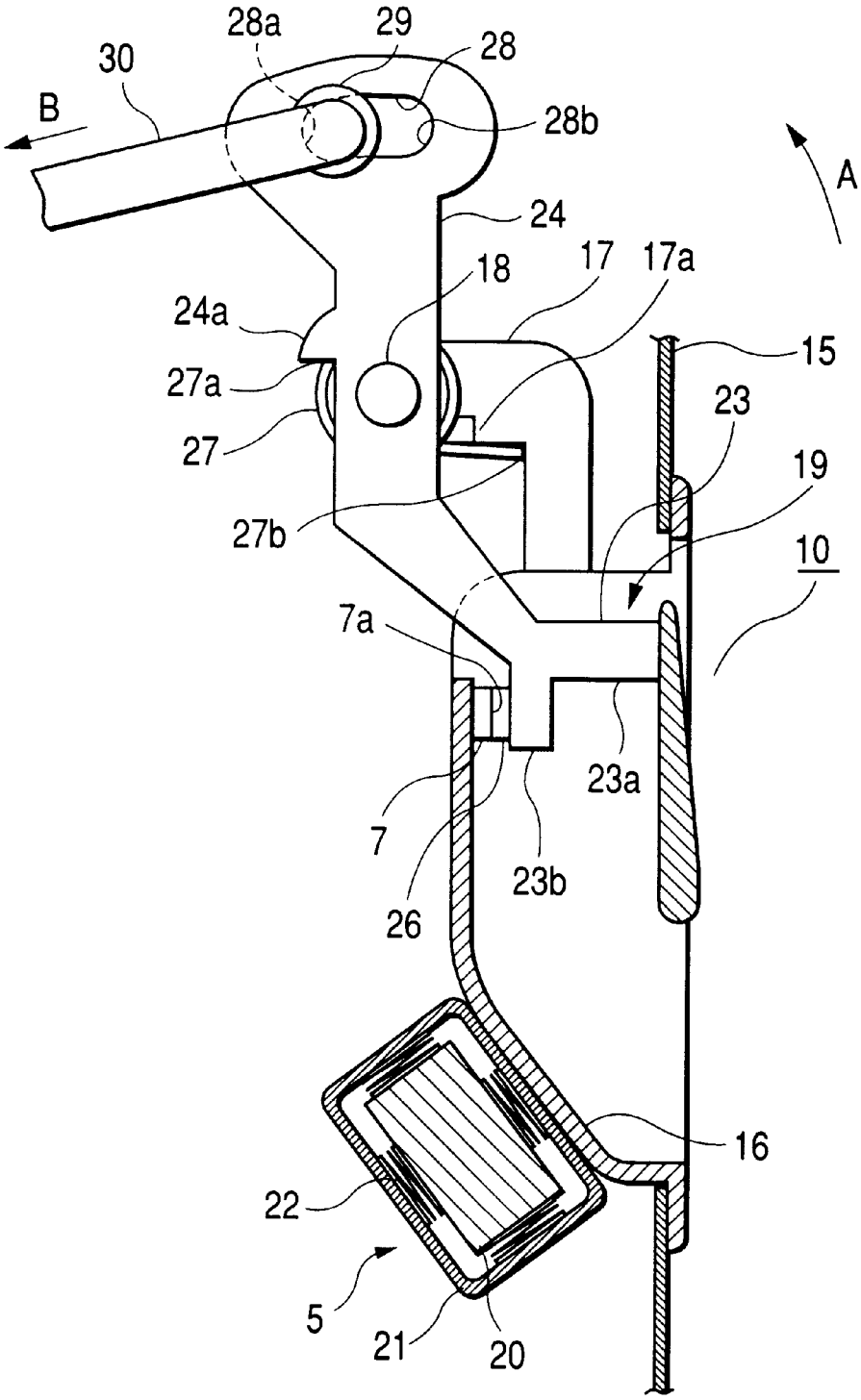
FIG. 3 is a longitudinal cross-sectional view showing an exterior door handle and an antenna.

As shown in FIG. 3, the foregoing antenna 5 is attached to a lower half internal surface of the handle bracket 16 (i.e., on the left-hand side of the bracket 16 shown in FIG. 1). The antenna 5 comprises a square-bar-shaped ferrite core 20, an antenna coil 21 which is coiled around the ferrite core 20 and is formed from an enameled wire, and a plastic antenna case 22 which covers the ferrite core 20 and the antenna coil 21.

The door knob 19 is placed on the external side of the handle bracket 16 (i.e., on the right-hand side of the bracket 16 shown in FIG. 1), and is integrally formed with an operation section 23 and an arm 24. A recess 23*a* for receiving the hand is formed in the operation section 23, and the arm 24 is placed in a position above the handle bracket 16 and extends in an upward direction.

The starter switch 7 is provided on an upper portion of the external surface of the handle bracket 16. In the door knob 19, a press member 26 is formed on a protuberance 23*b* constituting the recess 23*a* in such a way as to face the starter switch 7.

The starter switch 7 is formed from a strain gauge pressure sensor, and the press member 26 is always in pressed contact with the starter switch 7 (i.e., in a state such as that shown in FIGS. 1 and 3). Accordingly, pressure is applied to a pressure receiving section 7*a* which is an operation section of the starter switch 7. When the pressure receiving section 7*a* is released from a pressed state as a result of separation of the press member 26, the resistance of the strain gauge changes, whereby the start signal is output to the transceiver 3. In the pressure sensor constituting the starter switch 7, the pressure receiving section 7*a* is formed from a buffer substance; e.g., rubber. Therefore, physical shock caused when the press member 26 comes into contact with the pressure receiving section 7*a* can be absorbed.

A claw 24*a* is formed in a part of the arm 24, and one end 27*a* of a torsion coil spring 27 wrapped around the shaft 18 is held by the claw 24*a*. The other end 27*b* of the torsion coil spring 27 is held by a claw 17*a* formed on the support piece 17. With this configuration, the door knob 19 is forced in a direction opposite to the direction A (hereinafter referred to as the opposite direction) by means of the spring force of the torsion coil spring 27 and is retained in a position shown in FIG. 1.

An elongated hole 28 is formed in an upper end portion of the arm 24, and a link 29, which has an L-shaped front end and serves as an unlock device-is inserted into the hole 28 via a link bracket 29. The link 30 is usually positioned adjacent to one end 28*a* of the hole 28 (i.e., in a state such as that shown in FIGS. 1 and 3). In association with the pivotal movement of the door knob 19 in the direction A, the other end 28*b* of the hole 28 comes into contact with and presses the link bracket 29, so that the link 30 moves in a direction designated by arrow B (hereinafter referred to as direction B) shown in FIG. 1.

As a result of movement of the link 30, the latch mechanism of the door locking system 9 connected to the link 30 is unlatched on condition that the door locking system 9 has already been released from a locked state, thereby allowing the opening of the door 15.

Figure 4:
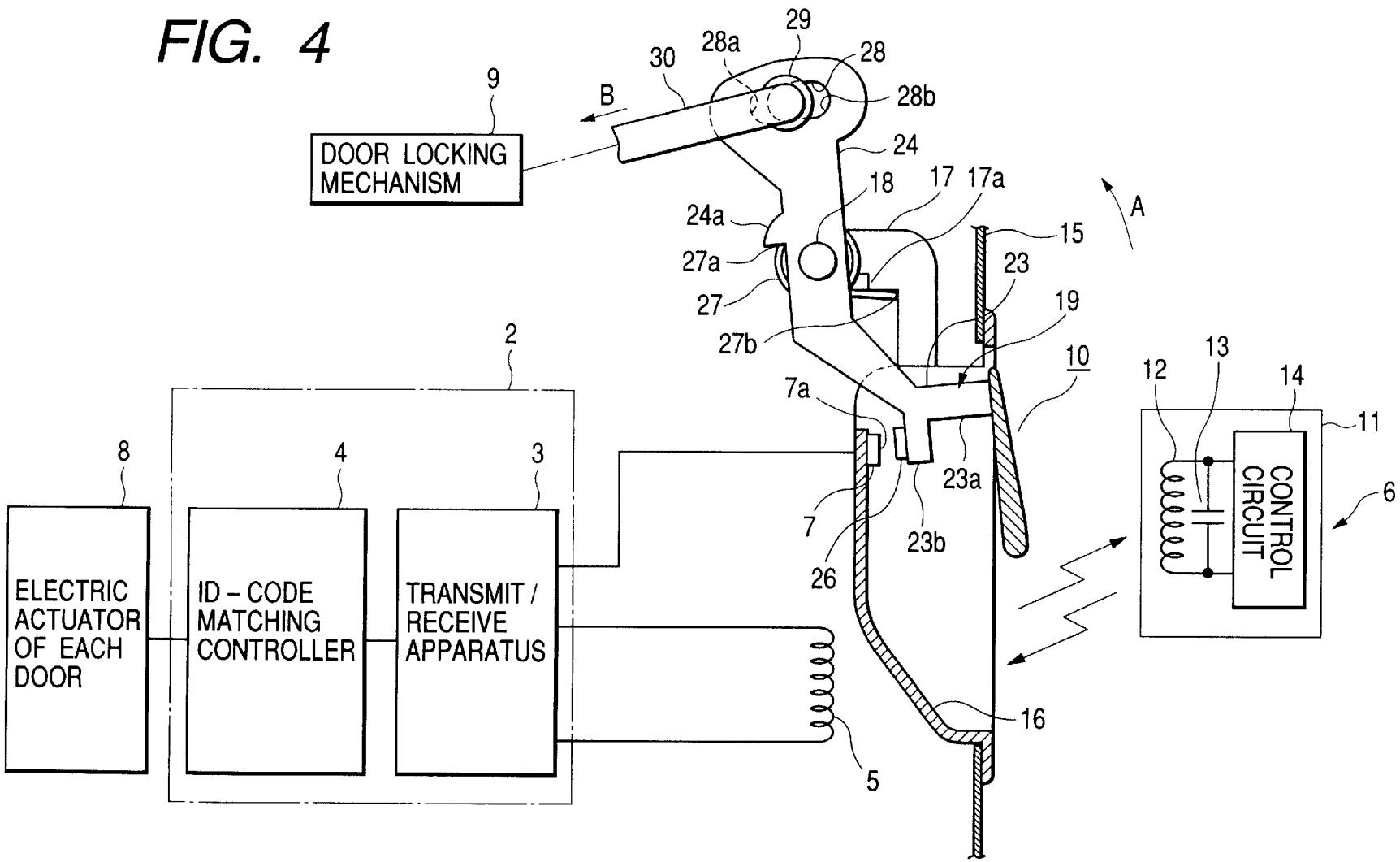
FIG. 4 is a view similar to FIG. 1, but showing a starter switch when it is turned on as a result of actuation of a door knob.
Figure 5:
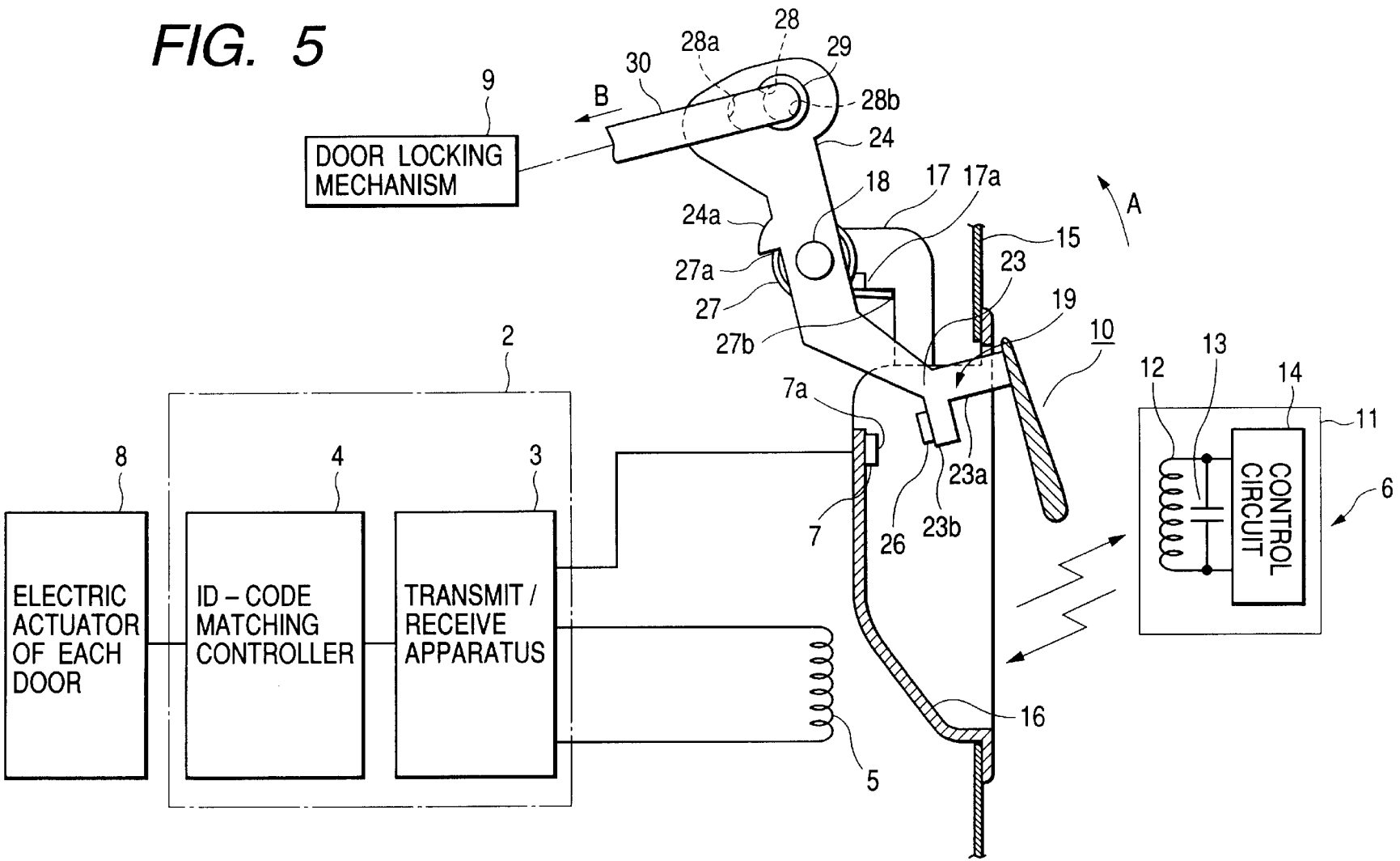
FIG. 5 is a view similar to FIG. 1, but showing the door knob when it is further actuated.
Figure 6:
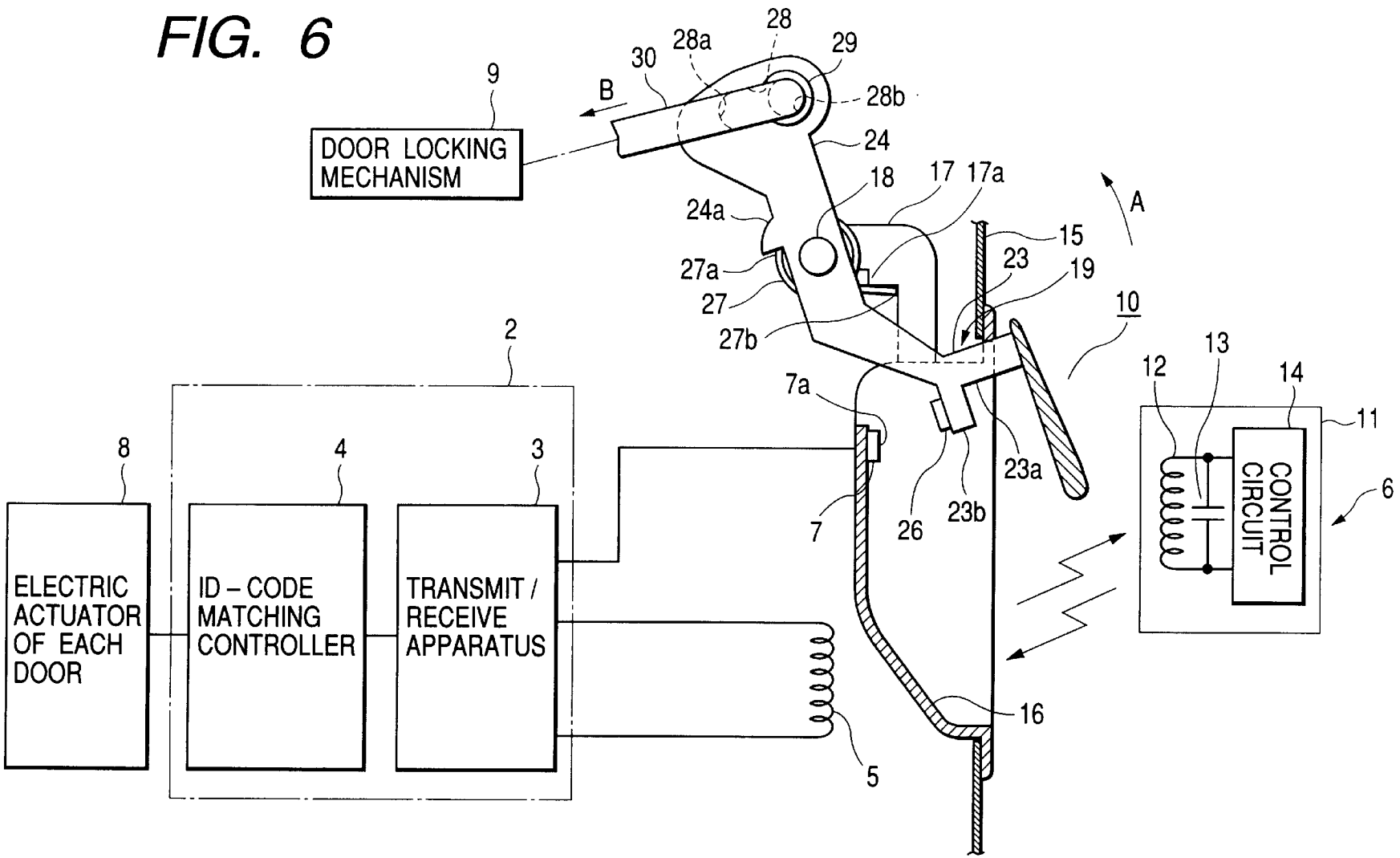
FIG. 6 is a view similar to FIG. 1, but showing a link when it is moved as a result of further actuation of the door knob.

Turning to FIGS. 4 through 6, as well as to FIGS. 1 through 3, the operation of the door unlocking device will be described with reference to a case where a driver mounts a vehicle by releasing the door locking mechanism 9 from a locked state.

First, the driver places its hand in the recess 23*a* of the door knob 19 while the IC card 11 is able to communicate with the transmit/receive apparatus 3 of the vehicle 1. The door knob 19 is pivoted in the direction A. At this time, in association with the pivotal movement of the door knob 19, the press member 26 is also pivoted; namely, the pressure receiving section 7*a* of the starter switch 7 is released from a pressed state. A start signal is then output to the transceiver 3.

Further, at this time, the hole 28 of the arm 24 is also pivoted so that the end 28*a* departs from the link bracket 29. However, the other end 28*b* of the hole 28 does not immediately come into contact with the link bracket 29. In short, the hole 28 pivots freely with respect to the link 30, thereby preventing movement of the link 30 (see FIG. 4).

Upon receipt of the start signal, the transmit/receive apparatus 3 sends a magnetic signal consisting of a power signal to the IC card 11 via the antenna 5. The IC card 11 receives the magnetic signal from the transmit/receive apparatus 3 as a request signal via the antenna 12. Upon receipt of the request signal, the control circuit 14 is activated and sends a drive signal to the parallel circuit consisting of the antenna 12 and the capacitor 13. Upon receipt of the drive signal from the control circuit 14, the antenna 12 sends as a response signal another magnetic signal including an identification code back to the antenna 5 of the vehicle body 1.

Upon receipt of the response signal from the IC card 11 via the antenna 5, the controller 2 decodes the identification code included in the response signal by means of the ID code matching controller 4 and determines whether or not the identification code matches a preset registration code. If there is a match between the identification code and the registration code, a door lock release instruction signal is output to the electric actuators 8 of the respective doors. Upon receipt of the door lock release instruction signal, the electric actuator 8 releases the door locking mechanism 9 from a locked state by application of electric power to the electromagnet for lock-releasing purposes.

Subsequently, when the door knob 19 is pivoted in the direction A in the previously-described state, the end 28*b* of the hole 28 of the arm 24 comes into contact with the link bracket 29 (see FIG. 5). When the door knob 19 is further pivoted to a predetermined pivotal position in the state, the end 28*b* of the hole 28 comes into contact with the ring bracket 29, thereby moving the link 30 in the direction B (see FIG. 6). In accordance with the movement of the link 30, the door locking mechanism 9 is actuated, thereby unlatching (unlocking) the latch mechanism which inhibits the opening of the door 15. As a result, the driver can mount the vehicle.

In the present embodiment, when the door knob 19 is pivoted, the commencement of the pivotal movement of the door knob is detected by the starter switch 7, so that the transmit/receive apparatus 3 is activated. In a case where there is a match between the identification code and the registration code, the door locking mechanism 9 is released from a locked state. When the door knob 19 is further pivoted to a predetermined position, the door locking mechanism 9 is unlocked.

As a result, it takes more time to decode an identification code in comparison with the time required for the existing door unlocking device to decode the identification code. The door locking mechanism 9 can be properly released from a locked state or unlocked, thereby resulting in improvement in the ease of use of the door unlocking device.

Particularly, the starter switch 7 including the pressure sensor is positioned on the handle bracket 16 of the exterior door handle 10, and hence the starter switch 7 immediately operates in association with the pivotal movement of the door knob 19, thereby enabling faster activation of the transceiver 3.

Since the pressure receiving section 7*a* of the starter switch 7 is formed from a buffer substance, the buffer can absorb physical shock which develops between the door knob 19 and the handle bracket 16 when the door knob 19 is returned to its original position by means of the torsion coil spring 27, thereby eliminating a need for an additional buffer member.

The present invention is not limited to the foregoing embodiment and can be subjected to the following modification.

More specifically, the transceiver 6 may be incorporated into a grip of an ignition key instead of being formed into the IC card 11.

Furthermore, the transceiver 6 may be provided with a battery, and the control circuit 14 may be usually held in a sleep state. In this case, the transmit/receive apparatus 3 sends a trigger signal to activate the transceiver 6, and the transceiver 6 sends a magnetic signal or a radio signal to the transmit/receive apparatus 3.

The starter switch 7 may be formed from a piezoelectric or capacitance type pressure sensor in place of a strain gauge type pressure sensor. Alternatively, the starter switch 7 may be formed from a contact type mechanical switch which uses a reversal leaf spring called "Beko Plate."

Second Embodiment

Figure 7:
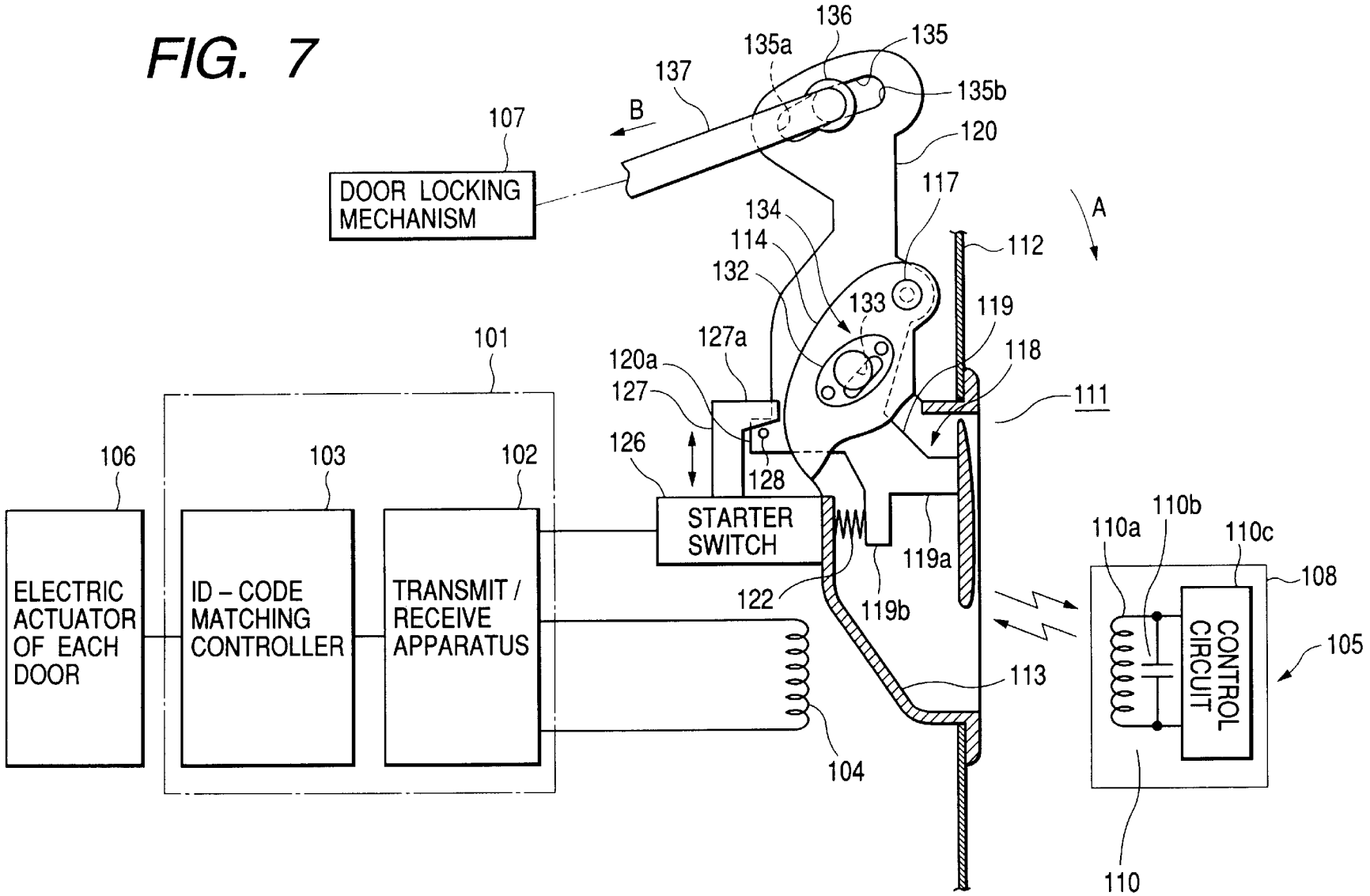
FIG. 7 is a partially-broken general view of a door unlocking device in accordance with one embodiment of the present invention.

By reference to the accompanying drawings, a second embodiment of the present invention will be described hereinbelow. FIG. 7 shows the overall structure of a door unlocking device for a vehicle. First, an electrical configuration of the door unlocking device will be described.

A controller 101 disposed on a vehicle body has a transmit/receive apparatus 102 and an ID code matching controller 103. The transmit/receive apparatus 102 has the function of sending as a request signal (corresponding to an operation signal which will be used hereinafter) a magnetic signal used for activating a transceiver 105 to be described later from an antenna 104, as well as the function of receiving as a response signal a magnetic signal including an identification code from the transceiver 105.

The ID code matching controller 103 decodes the identification code delivered from the transmit/receive apparatus 102 and determines whether or not the identification code matches a preset registration code. If there is a match between the codes, a door lock release instruction signal is output to an electric actuator 106 of each door. Upon receipt of the door lock release instruction signal, the electric actuator 106 applies electric power to an unillustrated electromagnet for unlocking purposes, to thereby releasing the door locking mechanism 107 from a locked state.

The foregoing transceiver 105 comprises; e.g., an ignition key 108. The ignition key 108 has a mechanical key plate 109. A built-in transmit/receive circuit 110 is housed in a grip 109*a* of the key plate 109 (see FIG. 9). The transmit/receive circuit 110 comprises an antenna coil 110*a* magnetically coupled to the antenna 104, a capacitor 110*b*, and a control circuit 110*c* made up of an IC. Upon receipt of a request signal from the transmit/receive apparatus 102, the transmit/receive circuit 110 sends a response signal to the antenna 104 of the vehicle body.

Figure 8:
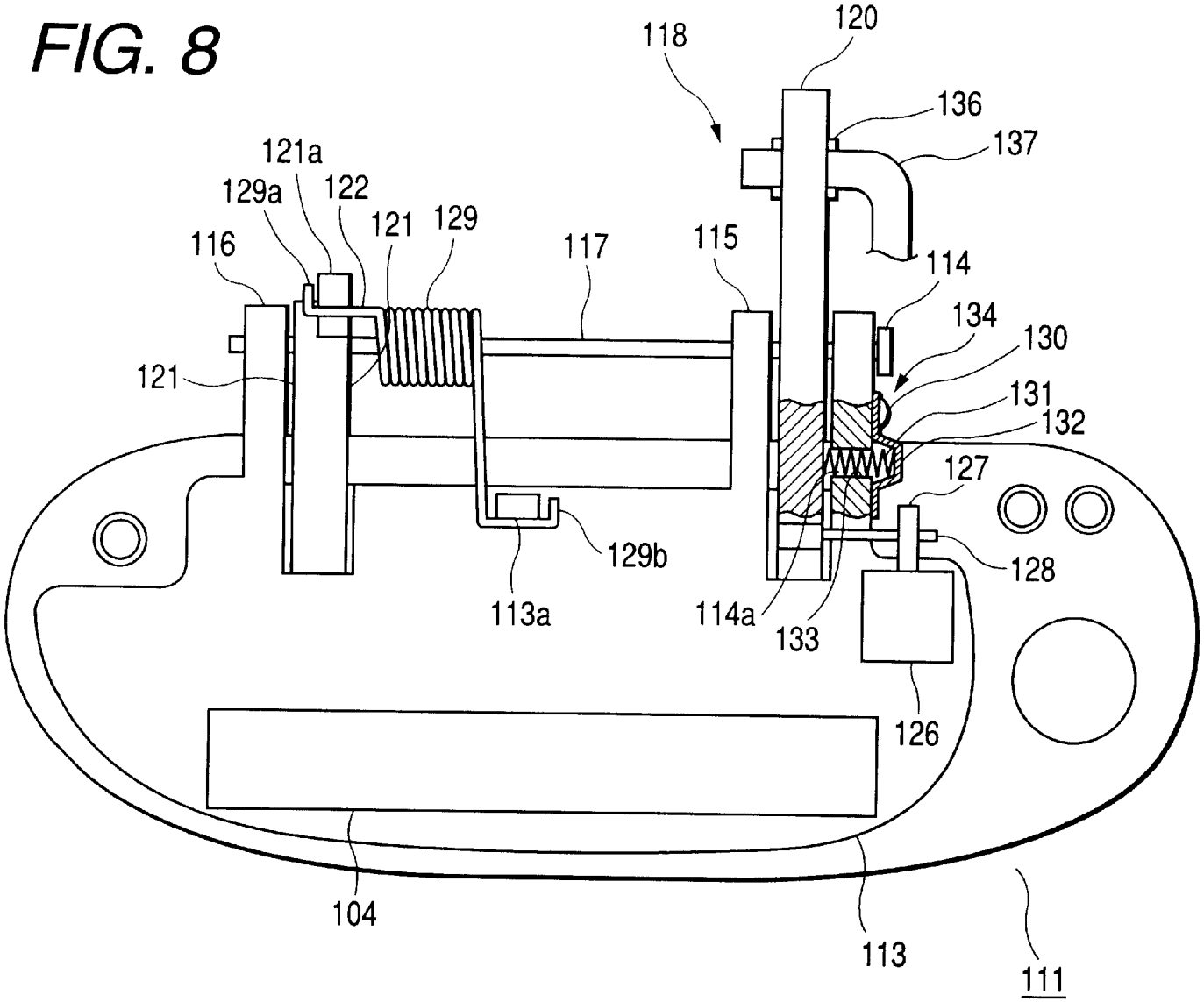
FIG. 8 is a rear view showing an exterior door handle.
Figure 9:
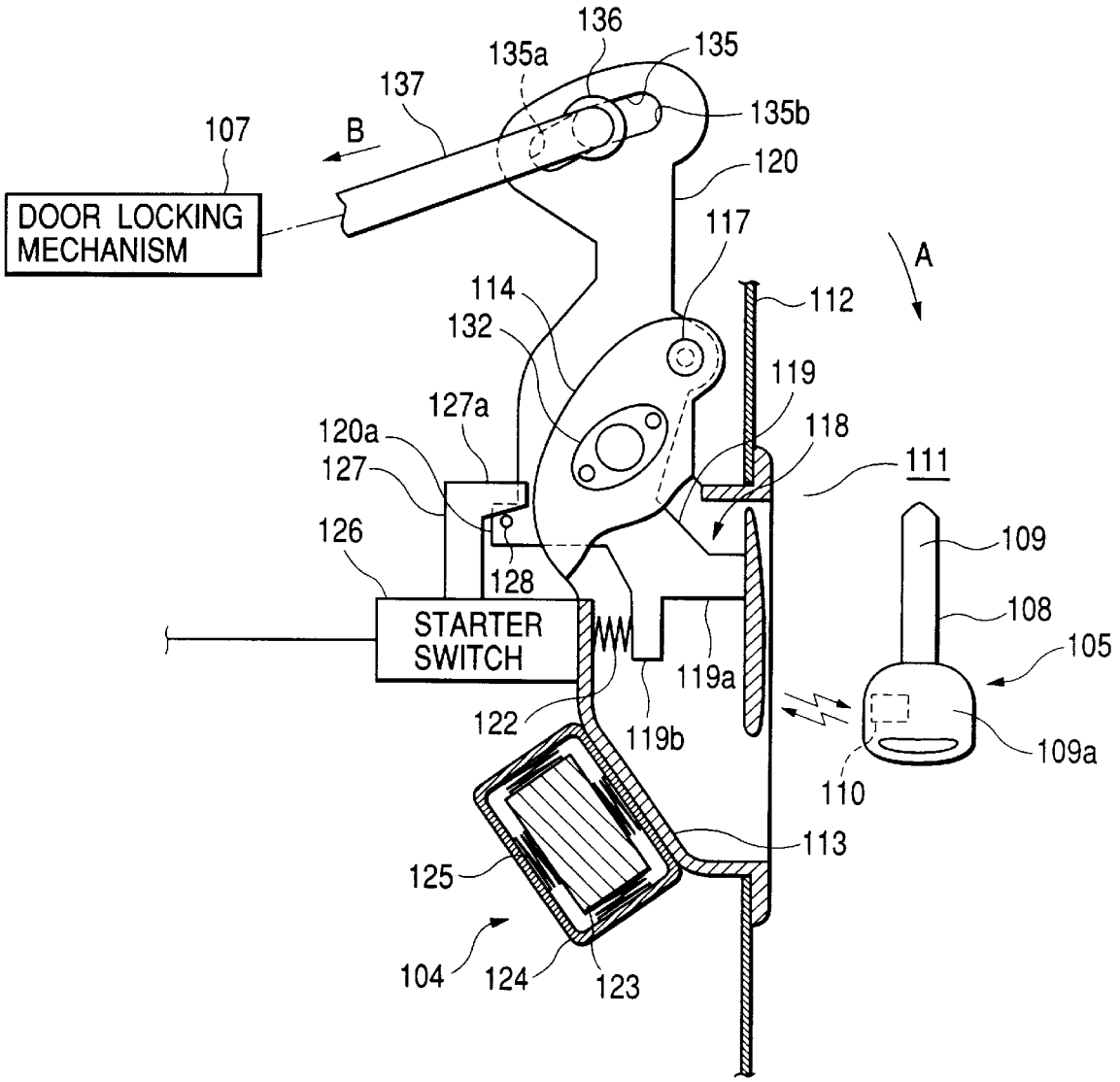
FIG. 9 is a longitudinal cross-sectional view showing the exterior door handle and an antenna.

A specific configuration of an exterior door handle 111 of the vehicle body will now be described by reference to FIGS. 8 and 9, as well as to FIG. 7. The exterior door handle 111 comprises a handle bracket 113 mounted on a door 112; support pieces 114, 115, and 116 upwardly protruding from an upper portion of the handle bracket 113; a shaft 117 passing through the support pieces 114, 115, and 116; and a door knob 118 supported by the support pieces 114, 115, and 116 via the shaft 117 so as to pivot in a direction designated by arrow A (hereinafter referred to as direction A) and in a direction opposite to the direction A (hereinafter referred to as the opposite direction) shown in FIG. 7.

The door knob 118 is placed on the external side of the handle bracket 113 (i.e., on the right-hand side of the bracket 113 shown in FIG. 7) and is integrally formed with an operation section 119 and arms 120 and 121. A recess 119*a* for receiving the hand is formed in the operation section 119, and the arms 120 and 121 are placed in a position above the handle bracket 113 and extend in an upward direction. A coil spring 122 is interposed between a protuberance 119*b* and the interior surface of the handle bracket 113, both of which constitute the recess 119*a* of the operation section 119. Here, FIG. 7 shows the structure of the exterior door handle 111 when viewed in the direction of the arm 120.

As shown in FIG. 7, the foregoing antenna 104 is attached to a lower half internal surface of the handle bracket 113 (i.e., on the left-hand side of the bracket 113 shown in FIG. 7). The antenna 104 comprises a square-bar-shaped ferrite core 123; an antenna coil 124 which is coiled around the ferrite core 123 and is formed from an enameled wire; and a plastic antenna case 125 which covers the ferrite core 123 and the antenna coil 124.

A starter switch 126 is provided on the internal surface of the handle bracket 113 in a position above the antenna 104. An operator 127 protrudes from an upper surface of the starter switch 126 in such a way as to be vertically movable. When the operator 127 is moved upwardly, the starter switch 126 is turned on and outputs a start signal to the transmit/receive apparatus 2 in order to activate the same. The operator 127 is constantly forced in a lower position (i.e., the position shown in FIGS. 7 and 9) at all times.

A projection 120*a* protrudes from the arm 120 toward the inside of the vehicle body, and a switch pin 128 is attached to the front end of the projection 120*a* so as to extend in a longitudinal direction of the door knob 118. The switch pin 128 is designed so as to come into contact with a hook 127*a* of the operator 127 when the door knob 118 is pivoted in the direction A. As a result, the operator 127 is moved in an upward direction, thereby turning on the starter switch 126.

A claw 121*a* is formed in a part of the arm 121, and one end 129*a* of a torsion coil spring 129 wrapped around the shaft 117 is held by the claw 121*a*. The other end 129*a* of the torsion coil spring 129 is held by a claw 113*a* formed on the handle bracket 113. With this configuration, the door knob 118 is retained in a position shown in FIG. 7 by means of the spring force of the torsion coil spring 129.

A hole 114*a* is formed in the support piece 114 and is closed by means of a cover 132 while a steel ball 130 and a coil spring 131 are inserted into the hole 114*a*. As a result, the steel ball 130 is maintained in pressed contact with the arm 120 by the spring force of the coil spring 131. Here, the steel ball 130 has a diameter sufficiently greater than the clearance between the arm 120 and the support piece 114.

A V-shaped groove 133 is formed in a preset position of the arm 120 so as to face the support piece 114. In the position where the starter switch 126 is turned on through pivotal movement of the door knob 118 in the direction A, the groove 133 faces the hole 114*a*. Tactile feedback device 134 employed in the present invention is formed from the hole 114*a*, the steel ball 130, the coil spring 131, the cover 132, and the groove 133 previously mentioned.

An elongated hole 135 is formed in an upper end portion of the arm 120, and a link 137, which has an L-shaped front end and serves as unlock device, is inserted into the hole 135 via a link bracket 136. The link 137 is positioned in substantially the center of the hole 135 (i.e., in a state such as that shown in FIGS. 7 and 9) at all times and travels along the inside of the hole 135 in association with the pivotal movement of the door knob 118.

When the door knob 118 is pivoted to a preset position (a first operation position according to the present invention) in the direction A, the end 135*a* of the hole 135 does not come into contact with the link bracket 136. In contrast, when the door knob 118 is pivoted to a given position in the opposite direction, the other end 135*b* of the hole 135 comes into contact with the link bracket 136.

If the door knob 118 is further pivoted in the opposite direction while the end 135*b* of the hole 135 is in contact with the link bracket 136, the link 137 moves in a direction designated by arrow B (hereinafter referred to as direction B) shown in FIG. 7. When the door knob 118 reaches a preset position (i.e., a second operation position according to the present invention), a latch mechanism of the door locking mechanism 107 connected to the link 137 is unlatched, thereby allowing opening of the door 112.

Figure 10:
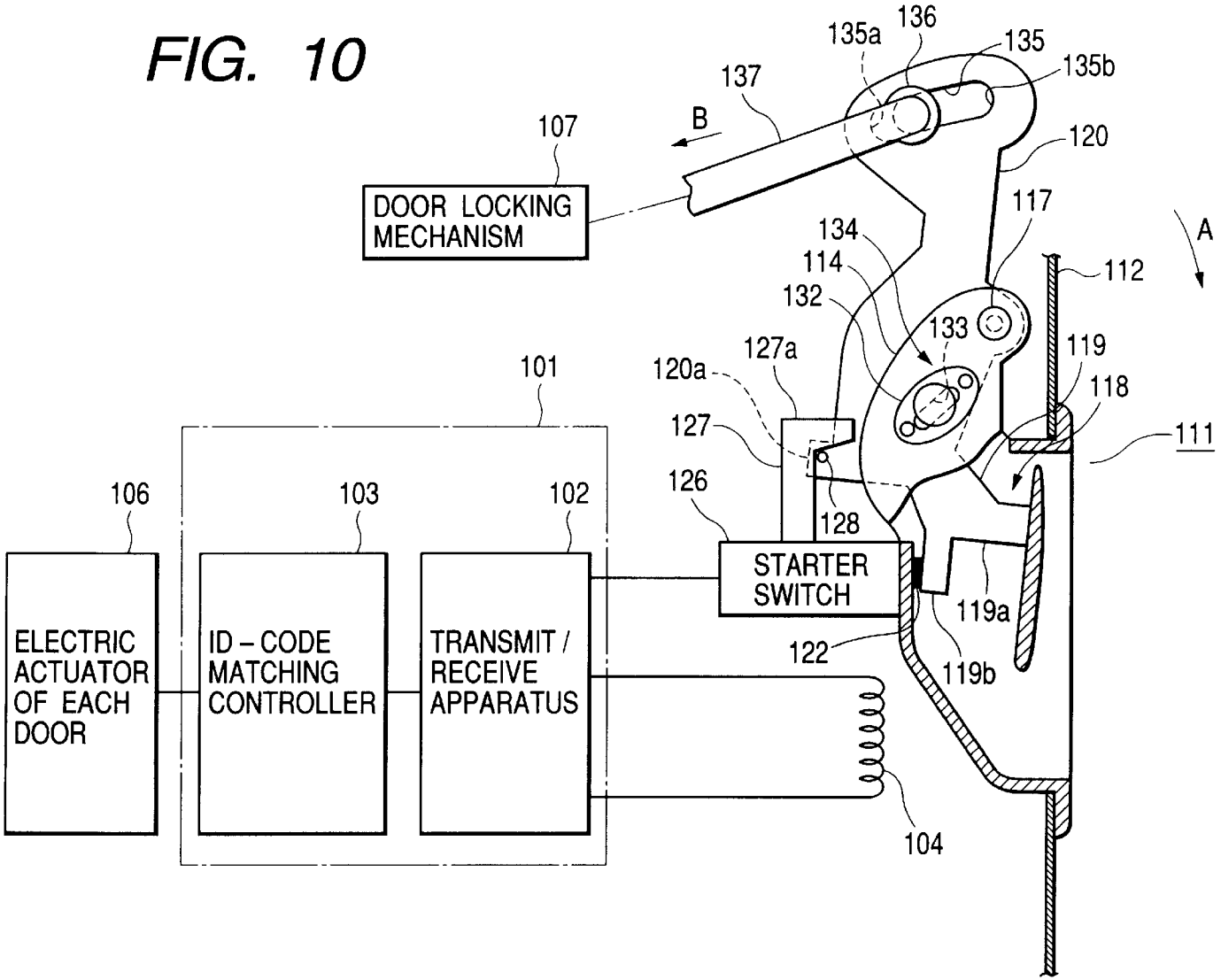
FIG. 10 is a view similar to FIG. 1, but showing a starter switch when it is turned on as a result of a first door handle actuation of a door knob.
Figure 11:
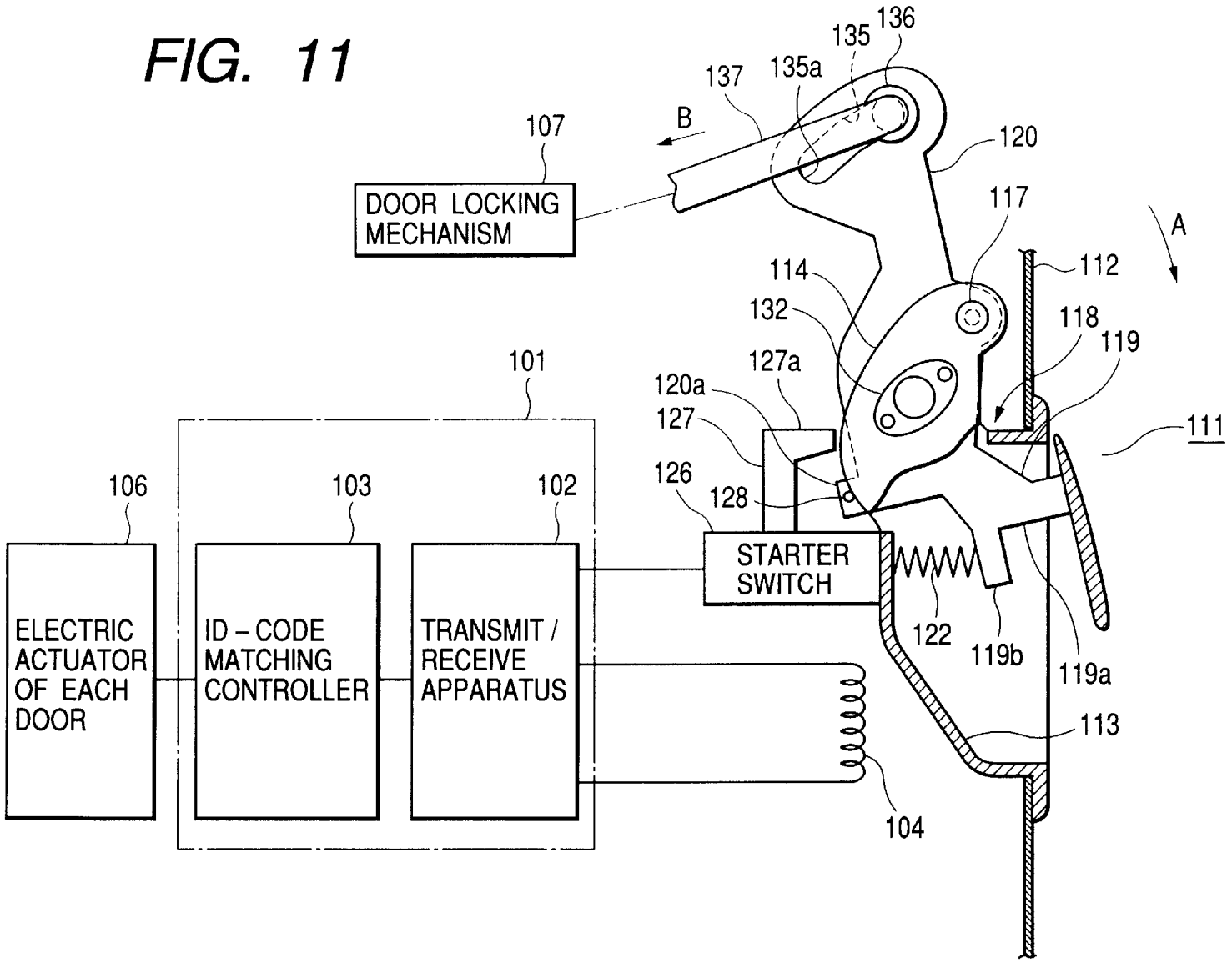
FIG. 11 is a view similar to FIG. 1, but showing a second door handle actuation of the door knob.
Figure 12:
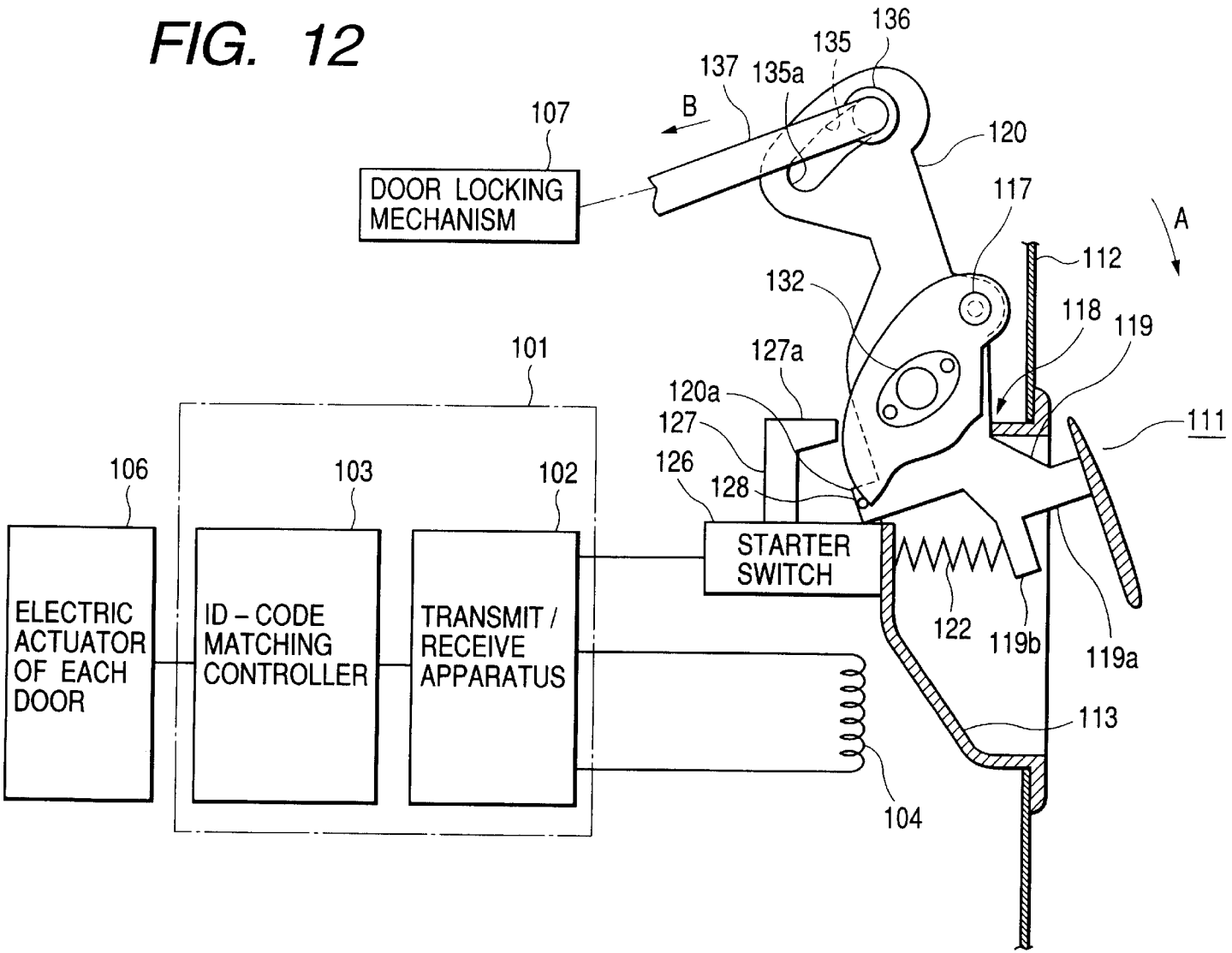
FIG. 12 is a view similar to FIG. 7, but showing a link when it is moved until it unlocks a door locking mechanism as a result of further actuation of the door knob.

Turning to FIGS. 10 through 12, as well as to FIGS. 7 through 9, the operation of the door unlocking device will be described with particularly reference to a case where a driver mounts a vehicle by releasing the door locking mechanism 107 from a locked state.

First, the driver places its hand in the recess 119*a* of the operation section 119 of the door knob 118 while the transmit/receive circuit 110 of the ignition key 108 is able to communicate with the transmit/receive apparatus 112 of the vehicle. The door knob 118 is pivoted in the direction A (i.e., first door handle actuation according to the present invention is performed).

In association with the pivotal movement of the door knob 118, the switch pin 128 attached to the projection 120*a* of the arm 120 is also pivoted in the direction A at this time. When the door knob 118 reaches the first operation position as a result of a given amount of actuation, the switch pin 128 comes into pressed contact with the claw 127*a* of the operator 127. The operator 127 is then moved in an upward direction, to thereby turn on the start switch 126 (see FIG. 10).

The groove 133 formed in the arm 120 is also pivoted in the direction A at this time and comes to a position where it faces the hole 114*a* of the support piece 114. The steel ball 130 pressed against the arm 120 falls into the groove 133 by the spring force of the coil spring 131, thereby imparting tactile feedback to the door knob 118.

The start switch 126, which is in an on state, sends a start signal to the transmit/receive apparatus 102. The transmit/receive apparatus 102 sends electric power in the form of a magnetic signal to the antenna coil 110*a* of the transmit/receive circuit 110 of the ignition key 108 from the antenna 104. The transmit/receive circuit 110 of the ignition key 108 derives electric power from the request signal; i.e., the magnetic signal, sent from the transmit/receive apparatus 102 and sends as a response signal another magnetic signal including an identification code back to the antenna 104 of the vehicle body from the antenna coil 110*a*.

Upon receipt of the response signal sent from the ignition key 108 through the antenna 104, the controller 101 decodes the identification code included in the response signal by means of the ID code matching controller 103 and determines whether or not the identification code matches a preset registration code. If there is a match between the identification code and the registration code, a door lock release instruction signal is output to the electric actuators 106 of the respective doors. Upon receipt of the lock release instruction signal, the electric actuator 106 releases the door locking mechanism 107 from a locked state by application of electric power to the electromagnet for lock-releasing purposes.

The hole 135 of the arm 120 is also pivoted in association with the foregoing pivotal movement of the door knob 118. However, as mentioned previously, the end 135*a* of the hole 135 does not come into contact with the link bracket 136; namely, the hole 135 turns freely with respect to the link 137, and therefore the link 137 is prevented from moving.

Subsequently, the door knob 118 is pivoted in the opposite direction (i.e., second door handle actuation is performed) in the previously-described state. When the door knob 118 is pivoted over a given distance, the end 135*b* of the hole 135 of the arm 120 comes into contact with the ring bracket 136 (see FIG. 11). If the door knob 118 is further pivoted from this position, the link 137 is moved in the direction B shown in FIG. 7.

When the door knob 118 reaches the second operation position (see FIG. 12), the door locking mechanism 107 is actuated in association with the movement of the link 137. As a result, the latch mechanism which inhibits the opening of the door 112 is unlatched; namely, the opening of the door 112 is allowed, the driver can mount a vehicle.

As described above, in the present embodiment, the starter switch 126 is turned on when the door knob 118 is actuated in the direction A up to the first operation position, and the decoding of the identification code is commenced. When the door knob 118 is pivoted to the second operation position in the opposite direction, the door locking mechanism 107 is unlocked. As a result, it becomes possible to gain time to decode the identification code. The door locking mechanism 107 can be properly released from a locked state and unlocked, thereby resulting in improvement in the ease of use of the door unlocking device.

Furthermore, the door unlocking device is arranged so as to impart tactile feedback to the door knob 118 by device of the tactile feedback device 134, and resistance is imparted to the actuation of the door knob 118 from the tactile feedback device 134. As a result, the driver can become aware of the timing at which the door locking mechanism 137 is unlocked. Furthermore, the door knob 118 can be actuated to the first operation position without fail, thereby preventing the pressing of the door knob 118 which is greater than required.

The present invention is not limited to the foregoing embodiment and can be subjected to the following modification. More specifically, a battery may be provided for the transceiver 105, and the control circuit 110*a* may be always maintained in a sleep state. The transmit/receive apparatus 102 may be arranged so as to send a trigger signal to the transceiver 105 in order to actuate the same. In response to the trigger signal, the transceiver 105 may send a radio signal to the transmit/receive apparatus 102.

As is evident from the foregoing description, in accordance with a first aspect of the invention, there is provided a door unlocking device for a vehicle. Namely, when a door knob of an exterior door handle is actuated to thereby press an operation section of the starter switch, the starter switch detects the commencement of operation of the door knob, thereby activating the transmit/receive device. In a case where there is a match between an identification code and a registration code, a door locking mechanism is released from a locked state by means of release device. When the door knob is further pivoted to a predetermined pivotal position, the door locking mechanism is unlocked by the unlock device.

As a result, when the door knob is actuated, the transmit/receive device is immediately activated. It takes a longer time to decode the identification code in comparison in comparison with the time required by the existing door unlocking device to decode the identification code. The door locking mechanism can be released from a locked state and unlocked properly, thereby resulting in an improvement in the ease of use of the door unlocking device.

In accordance with a second aspect of the present invention, the door unlocking device defined in the first aspect is further characterized by the feature that the starter switch is formed from a pressure sensor positioned on the handle bracket of the exterior door handle. Consequently, the pressure sensor operates in association with actuation of the door knob, whereby the transmit/receive device is activated much faster.

In accordance with a third aspect of the present invention, the door unlocking device defined in the first aspect is further characterized by the feature that the pressure sensor is formed so as to have the buffering capability of absorbing physical shock between the door knob and the handle bracket. The pressure sensor can absorb physical shock which arises between the door knob and the handle bracket when the door knob is returned to its original position.

As is evident from the foregoing description, in accordance with a fourth aspect of the invention, there is provided a door unlocking device for a vehicle. Namely, when a door knob is actuated to a first operation position through first door handle actuation, a starter switch activates transmit/receive device. If there is a match between an identification code and a registration code, a door locking mechanism is unlocked. If the door knob is actuated to a second operation position through second handle actuation; namely, through a actuation of the door knob in the direction opposite to the direction of the first door handle actuation, the door locking mechanism is unlocked by device of unlock means.

As a result, it takes a certain amount of time to actuate the door knob from the first operation position to the second operation position, which in turn makes it possible to gain time to decode the identification code. The door locking mechanism can be released from a locked state or unlocked properly, thereby resulting in an improvement in the ease of use of the door unlocking device.

A door unlocking device in accordance with a fifth aspect of the invention is provided with tactile feedback device for imparting tactile feedback to the door knob when the door knob is actuated to the first operation position. By virtue of the configuration, it becomes possible for the driver to become aware of the timing at which the door locking mechanism is unlocked, and to actuate the door knob to the first operation position without fail, thereby preventing the pressing of the door knob which is greater than required.

What is claimed is:

1. A door unlocking device for a vehicle comprising:

transmit/receive unit activated to send an operation signal to a portable transceiver and receiving an identification code from the transceiver;

a starter switch positioned in such a way that an operation section is pressed by a door knob of an exterior door handle when the door knob is not actuated, and activating the transmit/receive device when detecting the initiation of actuation of the door knob by release of the operation section;

release unit releasing a door locking mechanism from a locked state when the identification code matches a preset registration code; and unlock unit unlocking the door locking mechanism when the door knob of the exterior door handle is actuated to a predetermined position.

2. The door unlocking device as defined in claim 1, wherein the starter switch includes a pressure sensor positioned on a handle bracket of the exterior door handle.

3. The door unlocking device as defined in claim 2, wherein the pressure sensor has the capability of absorbing physical shock arising between the door knob and the handle bracket.

4. A door unlocking device for a vehicle comprising:

transmit/receive device activated to send an operation signal to a portable transceiver and receives an identification code from the transceiver, the transmit/receive device unlocking a door locking mechanism when the identification code matches a preset registration code;

a starter switch activating the transmit/receive device when a door knob of an exterior door handle is pressed toward a vehicle body through first door handle actuation, and the door knob actuated to a first operation position; and unlock unit unlocking the door locking mechanism when the door knob of the exterior door handle is actuated to a second operation position as a result of second door handle actuation subsequent to the first door handle actuation in the direction opposite to the direction of the first door handle actuation.

5. The door unlocking device as defined in claim 4, further comprising:

tactile feedback unit imparting tactile feedback to the door knob when the door knob is actuated to the first operation position.

* * * * *